US006368430B1

(12) United States Patent
Bennon et al.

(10) Patent No.: US 6,368,430 B1
(45) Date of Patent: Apr. 9, 2002

(54) PROCESS FOR QUENCHING HEAT TREATABLE METAL ALLOYS

(75) Inventors: William D. Bennon, Monroeville, PA (US); James P. Jones, Bettendorf, IA (US); Daniel T. Moulton, Bettendorf, IA (US); Gene R. Walker, Bettendorf, IA (US)

(73) Assignee: Alcoa Inc., Alcoa Center, PA (US)

( * ) Notice: Subject to any disclaimer, the term of this patent is extended or adjusted under 35 U.S.C. 154(b) by 0 days.

(21) Appl. No.: 09/381,870

(22) PCT Filed: Mar. 24, 1998

(86) PCT No.: PCT/US98/05689

§ 371 Date: Nov. 18, 1999

§ 102(e) Date: Nov. 18, 1999

(87) PCT Pub. No.: WO98/42885

PCT Pub. Date: Oct. 1, 1998

Related U.S. Application Data

(60) Provisional application No. 60/041,540, filed on Mar. 25, 1997.

(51) Int. Cl.[7] ..... C22F 1/04
(52) U.S. Cl. ..... 148/703; 148/713
(58) Field of Search ..... 148/703, 713

(56) References Cited

U.S. PATENT DOCUMENTS

| | | | | |
|---|---|---|---|---|
| 3,533,261 A | | 10/1970 | Hollander | 72/201 |
| 4,073,332 A | | 2/1978 | Etienne | 164/4 |
| 4,610,735 A | | 9/1986 | Dubost | 148/128 |
| 5,112,412 A | | 5/1992 | Plata et al. | 148/688 |
| RE34,442 E | | 11/1993 | Reiso | 148/550 |
| 5,382,306 A | | 1/1995 | Plata et al. | 148/511 |
| 5,447,583 A | | 9/1995 | Arthur et al. | 148/689 |
| 5,496,423 A | | 3/1996 | Wyatt-Mair et al. | 148/551 |
| 5,697,169 A | * | 12/1997 | Jacob | 34/393 |
| 5,820,705 A | * | 10/1998 | Yu et al. | 148/633 |

FOREIGN PATENT DOCUMENTS

| | | |
|---|---|---|
| DE | 1508432 | 10/1969 |
| EP | 0334803 | 9/1989 |
| FR | 2571384 | 4/1986 |
| JP | 61189845 | 8/1986 |
| WO | 9426939 | 11/1994 |

* cited by examiner

*Primary Examiner*—Melvyn Andrews
(74) *Attorney, Agent, or Firm*—Ladas & Parry

(57) ABSTRACT

The present invention is directed to a process comprised of a controllably variable liquid quenching means for metal alloys at or above the Leidenfrost temperature without metal alloy distortion.

18 Claims, 4 Drawing Sheets

PROCESS FOR QUENCHING HEAT TREATABLE METAL ALLOYS

This application claims the benefit of U.S. Provisional Applilcation No. 60/041,540 filed Mar. 25, 1997.

The present invention is directed to a process and the product of that process wherein a quenching means is employed that is controllably variable and provides a metal alloy with increased strength imparted to the alloy during finishing of the alloy manufacture. The quenching means is through the use of a liquid after the alloy has been worked and/or heat treated, followed by an air quench.

It is well known by those skilled in the metal alloy art that working and/or heating an alloy, and subsequently following that worked and/or heated alloy with a quenching step, may impart enhanced properties. A problem in the manufacture of thinner sheet alloy is that quenching a thin sheet alloy can cause multi-directional thermal distortion in the final product. What was a flat unwavering product becomes a bent, uneven, and/or physically distorted sheet alloy. While this problem is particularly troublesome in the thin sheet alloy art, it is also a problem in the forged and cast alloy art.

Heat treatable alloys contain soluble alloying constituents in amounts which exceed their room temperature solubility limits. The solution heat treating process involves heating the alloy to a sufficient temperature to permit desired constituents to go into solid solution. The resultant supersaturated solid solution can be sustained at room temperature if cooled or quenched rapidly enough to prevent precipitation. Constituents in an alloy system mean those minor metal components in the alloy that can have a significant impact on properties if present in the right place in the alloy and in the right amount. Room temperature mechanical and physical properties can depend on the extent to which the alloy constituents remain in solid solution.

Elevated temperature quenching can also result in undesirable physical distortion of the metal strand due to thermal contraction of the alloy. A strand can be sheet, slab, extrusion or other worked and/or heat treated metal alloy based in an iron, magnesium, titanium, and/or aluminum system, preferably aluminum alloy. In a continuous or semi-continuous process, the magnitude of distortion is proportional to the rate the strand is cooled. Achieving desirable mechanical properties by solution heat treatment followed by a quenching step then involves competing interests between enhanced mechanical properties and thermally induced physical distortion.

The present invention is useful for the high speed manufacture of metal alloys with higher strength values. These alloys may then be used to make articles of manufacture.

A process for the manufacture of metal alloys wherein a controllably variable liquid quenching means is used to rapidly cool the metal alloy at or above the Leidenfrost temperature prior to and in combination with an air quenching means and alter heat treatment whereby the metal alloy is quenched without metal alloy distortion providing a metal alloy with superior tensile strength properties. The process is comprised of finishing metal alloy on a horizontal bed, translation of said metal alloy sequentially through a solution heat treating furnace, a liquid quench chamber with a single and/or a plurality of controllably variable spray orifices, followed by a gas quench chamber. The spray orifices create a spray or mist in order to wet the metal alloy. While the preferred finishing bed is on a horizontal translation, the underlying invention is not planar dependent in the horizontal direction and embraces all directional translations, such as vertically. The invention hereof is specifically directed to the effective length of the liquid quench chamber, the enablement of which is the use of multiple zones of liquid flow through orifices. By zones it is meant an area within the liquid quench chamber whereby a plurality of separate orifices may be individually controlled within the liquid quench chamber. The number of zones and/or the time spent in a zone for a metal alloy, preferably aluminum alloy, may be controlled in consideration of the composition of the alloy being processed, the size of the strand, the speed of the translation and the liquid treatment or application means operating parameters, such as orifice type, pressure, the physical properties of the liquid, and flow rate. The gas is preferably air; however, any inert or benign gas will be sufficient to cool the strand.

The desired cooling rate is also dependent upon the kinetics of precipitation. The kinetic rate is temperature and solute dependent. The kinetic rate constant is temperature dependent. The rate constant is nearly zero at high and low temperatures. Accordingly, the loss of strength associated with a loss of solute from solution approaches zero at these high and low temperatures. For temperatures in a certain regime, near what is called the critical temperature, the kinetic constant is of sufficient magnitude to effect losses of solute from solution and lead to decreased strength potential in the alloy. The importance of the quench is to minimize the loss of solute from the solution. Therefore, an understanding of the cooling rates, particularly in the critical temperature range, provides insight into how the cooling rate can be maximized. To determine how to vary the controllable or tunable quench, it is important to know the temperature regime near the critical temperature. The rapid cooling of metals leads to undesirable residual stresses and distortion in the metal alloy. Increased cooling rates are accompanied by increases in thermally induced stresses. If these stresses occur at elevated strand temperatures, they can become permanent plastic deformations in the alloy. Thermally induced residual stress and physical distortion can be minimized by reducing product cooling rates. Distortion is also influenced by the thickness of the metal alloy which may be within a range of 0.01 to 8 inches thick. The thicker or metal alloy slabs will be less sensitive to the distortion than the thinner strips or slabs.

The challenge is to provide cooling rates which are sufficiently high to retain solute in solid solution but not in excess of those which lead to permanent plastic distortion. The magic of the present invention is the advantage that is taken by spraying liquid, preferably water, onto the surfaces of the metal alloy at elevated temperatures. Other liquids, such as water/glycol combinations or other organic liquids such as alcohols may be used if they have the appropriate sprayability and viscosity to exit the orifices and quench the strand. Additionally, dissolved gases such as $CO_2$ may be used in the liquid coolant. The liquid quench cools the metal through the critical temperature at a rate that can be controllably varied from each metal alloy composition and can increase or at least maintain the strength potential of the alloy without physical distortion. Heretofore, the air quench was believed to provide the highest strength characteristics with minimum metal alloy distortion.

For the cooling of continuous and/or semi-continuous strands or metal alloy, the present invention makes use of an array of zoned water flow-through spray orifices in order to control the time which the strand remains above the critical temperature. While the inventors hereof do not want to be held to any particular theory of operability of the present invention, some theory may aid in the understanding of these teachings for those skilled in this art. The heat flux of a heat treated strand can undergo a rapid order of magnitude increase as the alloy is cooled below the temperature $T_L$ known as the Leidenfrost temperature, which may be between about 350° to 700° F., depending upon the metal alloy. Above $T_L$, the alloy is blanketed by a vapor film which limits the heat removal. When the temperature drops below $T_L$, the vapor film breaks down, the surface is wetted by the water droplets, and the heat flux can increase dramatically. $T_L$ is functionally and operatively related to the specific spray orifice, flow rate, physical and chemical properties of the liquid, and pressure used to apply the liquid, the liquid preferably being water. $T_L$ is also related to the momentum of the droplets which contact the strand surface. Droplet momentum can be increased by increasing droplet size or increasing its impact velocity. High momentum droplets more easily penetrate the vapor film, thereby increasing $T_L$. For a given liquid, spray orifice or nozzle configuration, flow rate, and pressure, $T_L$ is constant.

Important for the operability of the present invention is the operation of the water quench mechanism in order to maximize the time the strand remains above $T_L$. Maintaining the temperature above $T_L$ delays the rapid increase in the cooling rate until the strand is sufficiently rigid to resist plastic distortion. Contemplated within the reach of the present invention is that for certain alloys and/or strand sizes, the desired mechanical properties can be achieved by operating the water quench exclusively above $T_L$. For certain alloys and strand sizes, no liquid cooling is required, and sufficient strengths can be achieved by gas cooling.

Aluminum alloys, especially those heat treatable alloys of the 6XXX, 2XXX, and 7XXX series known also as the 6000, 2000, and 7000 series aluminum alloys, preferably Aluminum Association registered alloys, 2008, 6022, and 6111, are particularly advantaged by the use of liquid quenching followed by a gas, preferably air, quench.

Figure 5A:
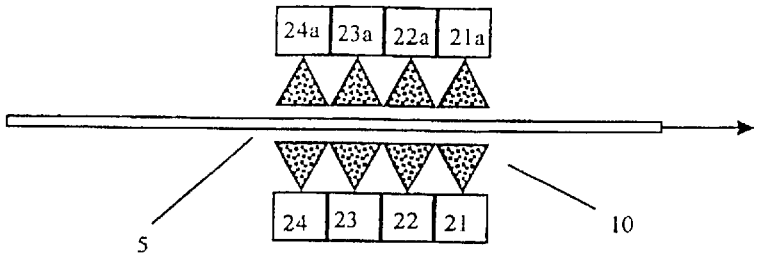
Figure 5A:
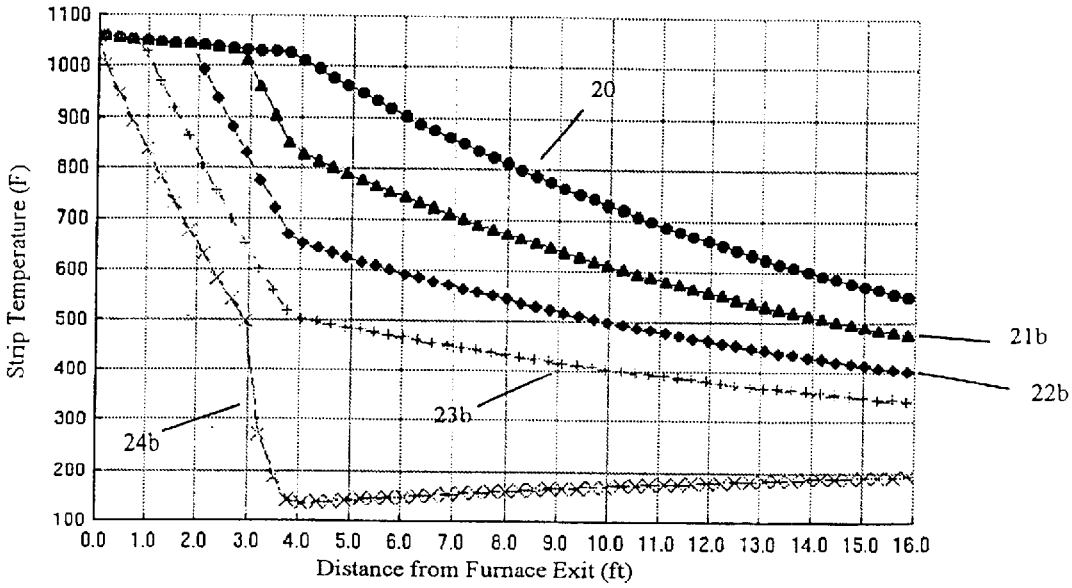
Figure 5B:
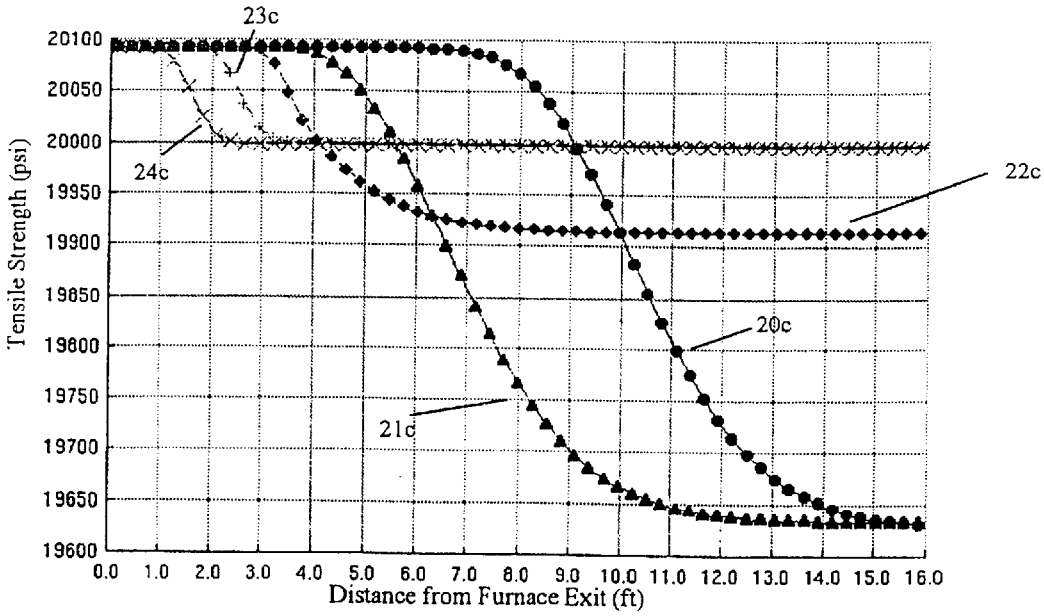

FIGS. 5*a* and 5*b* show a multi-zoned array of spray orifices and plots corresponding to strand temperature and tensile strength versus distance from the furnace.

Figure 6A:
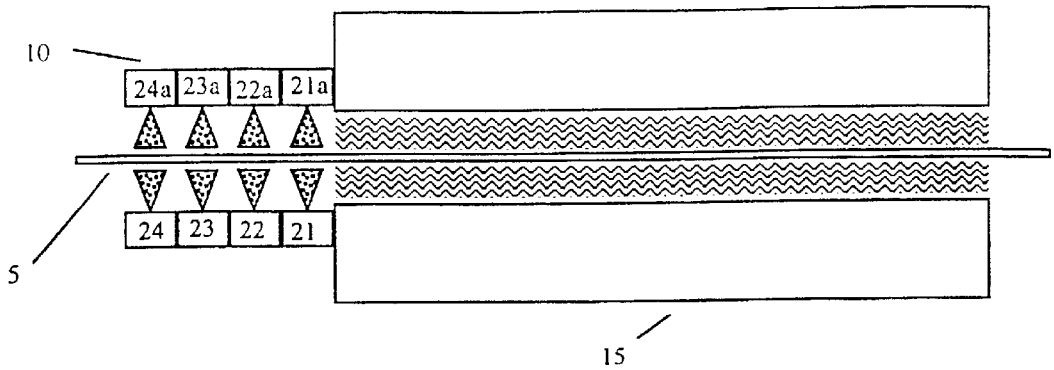
Figure 6A:
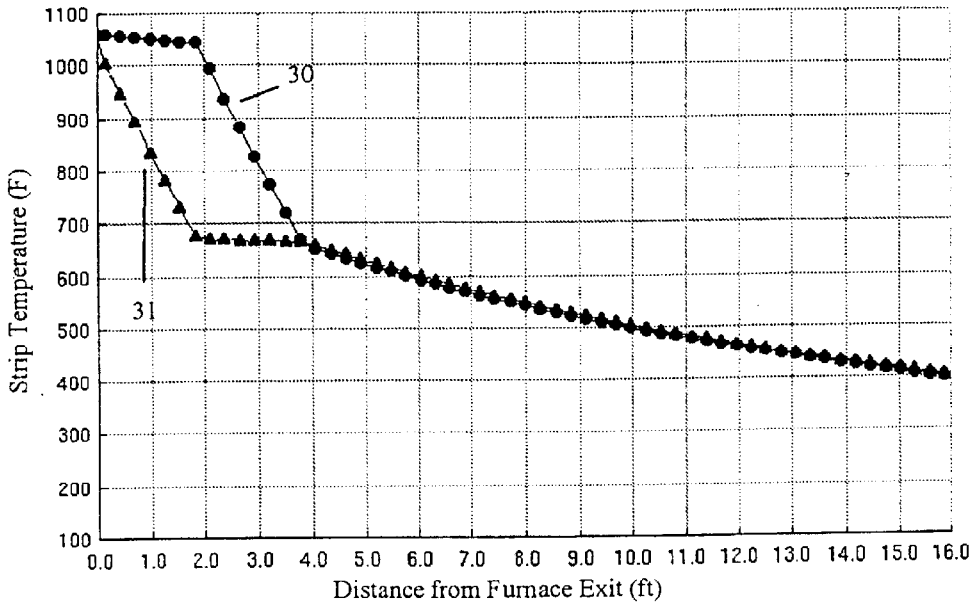
Figure 6B:
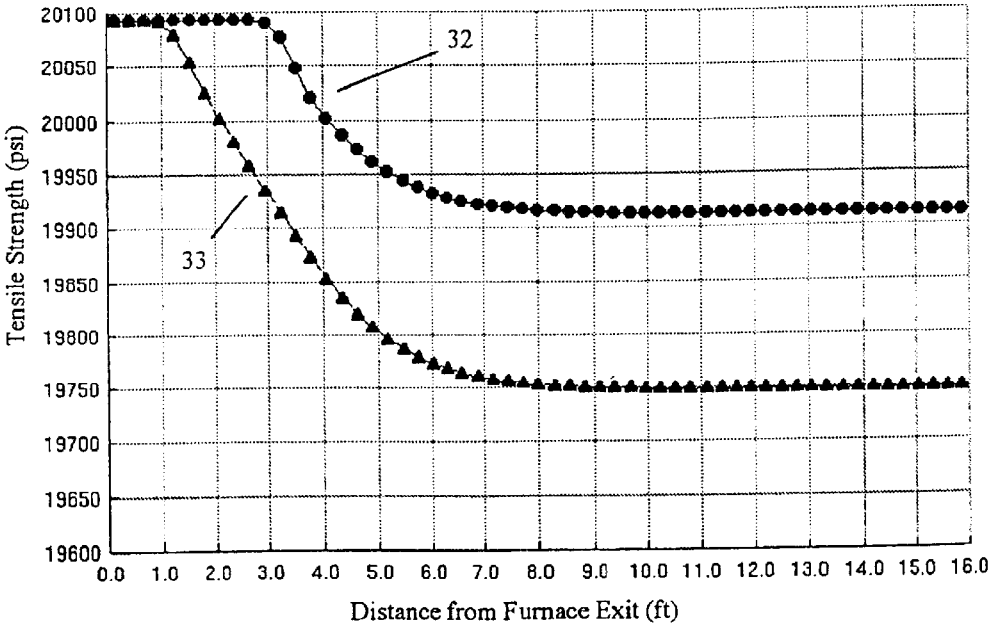

FIGS. 6*a* and 6*b* show the quench station and plots of strip temperature and tensile strength versus furnace exit for the use of different positioned spray orifices.

Figure 1:
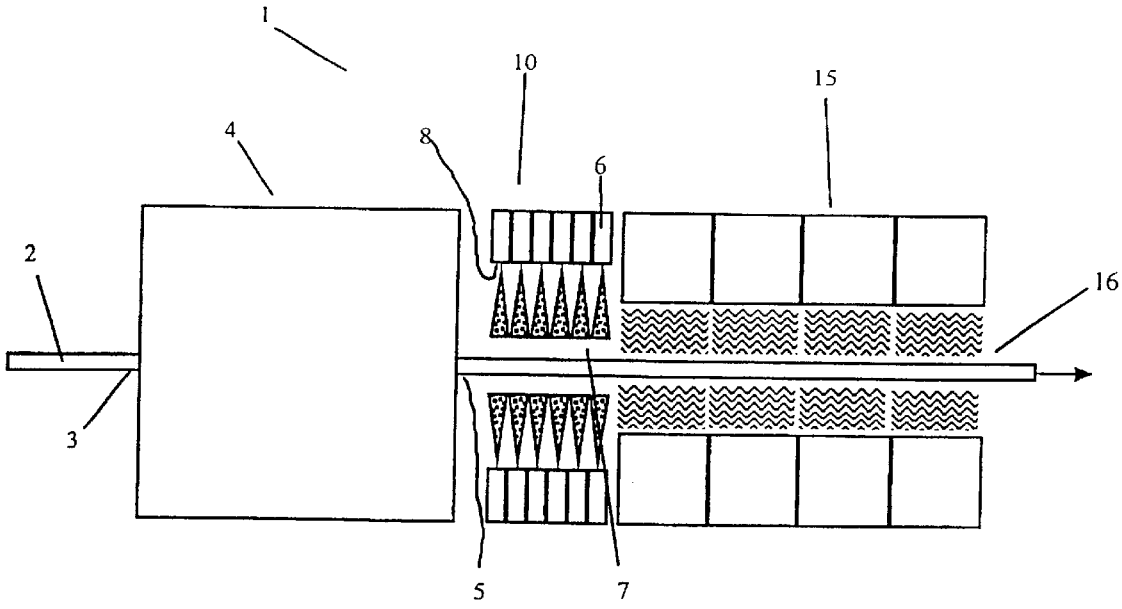
FIG. 1 is a side view of the general apparatus and the stations used in the present invention.

With reference to FIG. 1, the apparatus 1 comprises a heat treating chamber 4, a liquid quenching chamber 10, and a gas quenching chamber 15. The strand 2 moves horizontally into the heat treatment chamber at entrance 3 and into heat treatment chamber 4 where the alloy is heated above the alloy dependent solutionizing temperature, normally for aluminum alloys between 600° and 1200° F. The now heated strand exits the heat treatment chamber at exit 5 and enters the liquid quenching chamber 10. A plurality of liquid controlling zones 6 are controllably varied to liquid quench the strand in the liquid quench chamber 10, quenching area 7. Each zone may comprise a single or a plurality of spray orifices 8, and each zone may be activated singly, as a plurality, sequentially, and in concert as necessary to maximize the time spent as the strand approaches $T_L$ in the liquid quench chamber 10. Operatively, the orifices within each or a plurality of zones may be of variable size. A single or a plurality of orifices 8 are positioned in the interior portion of zone 6 so that the liquid spray is positioned to spray interiorly into the quenching area 7. Alter liquid quenching, preferably with water, the strand may be gas quenched in the gas quenching chamber 15. Preferably the gas is air. The strand then exits the apparatus 1 at the exit end 16.

In the practice of the present invention, it is important to understand some of the properties of the strand or alloy that is to be heat treated and quenched. For example, it is preferred to maximize the time the strand remains above the temperature $T_L$. This residence time above $T_L$ delays the rapid increase in cooling rate until the strand is sufficiently strong to resist plastic distortion. It is contemplated within the metes and bounds of the present invention that cooling partially above $T_L$ and partially below $T_L$ will provide an advantage by the liquid quenching step.

Figure 3:
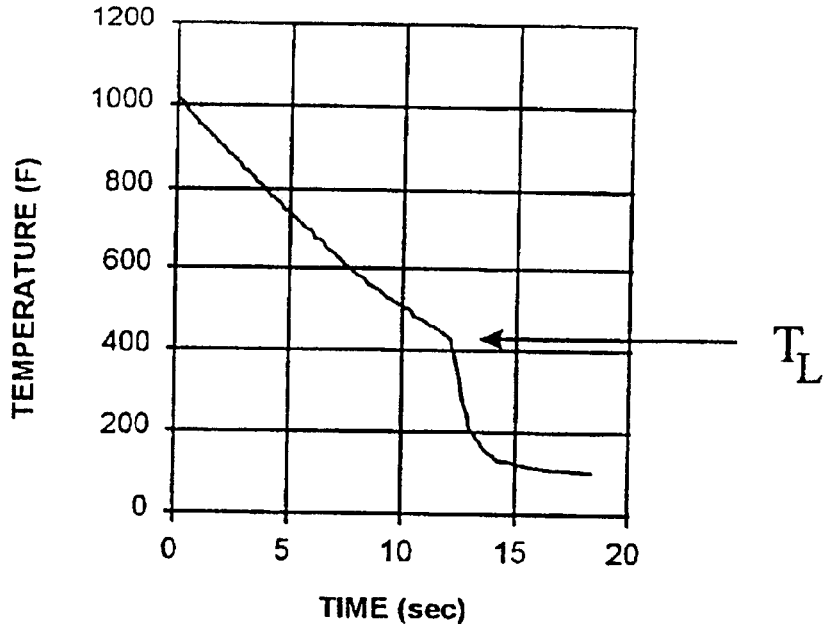
FIG. 3 is a time versus temperature plot of data taken on a metal alloy showing $T_L$ at the sharp break in the curve.
Figure 4:
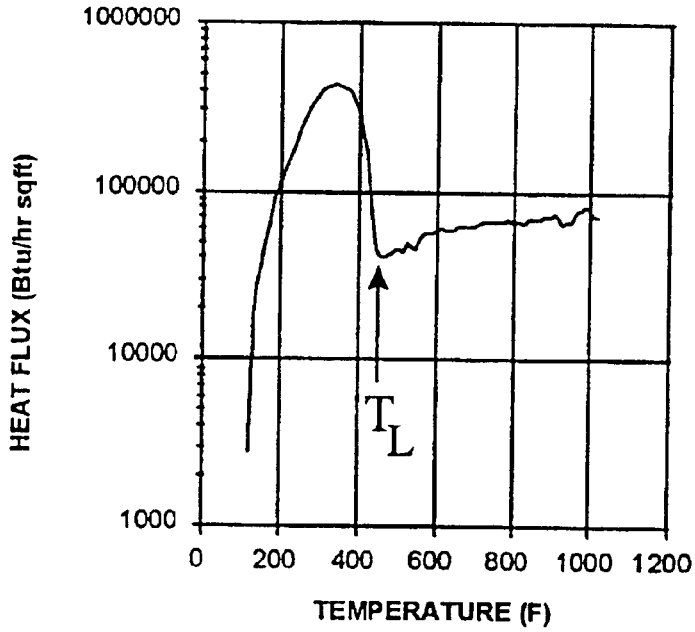
FIG. 4 is a plot of heat flux versus temperature showing $T_L$ as the heat flux increases dramatically.

The $T_L$ or Leidenfrost temperature can be determined experimentally. Time and temperature curves can be generated as is shown in FIG. 3. The $T_L$ temperature is defined at the sharp break in the time-temperature curve. A plot of heat flux versus temperature as shown in FIG. 4 also shows the $T_L$ temperature. As the strand cools FIG. 4 illustrates $T_L$ as the temperature where the heat flux increases dramatically. This plot should be read from the right to the left as the temperature decreases during liquid quenching. Once $T_L$ is determined, the operation of the tunable quenching chamber is enabled since residence time and/or number of operable orifices required to quench above the $T_L$ temperature can be effected. It is notable that once a strand has exited the liquid quenching means at or above the Leidenfrost temperature the strand is substantially free of liquid induced staining. This is important in the intended market for this product.

Figure 2:
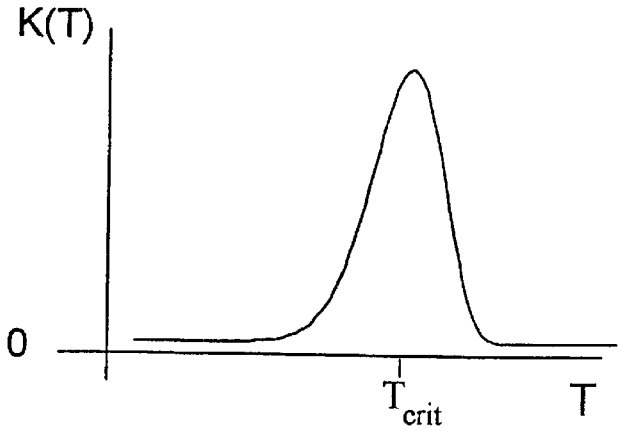
FIG. 2 is a plot of the rate constant versus temperature which shows $T_{crit}$ as the maxima.

Also important is the $T_{crit}$ or the critical temperature. The impact of precipitation on strength can be expressed in equation form as $$\frac{d\sigma}{dt} = -K(T)\{\sigma - \sigma_{\min}(T)\}$$

where a is the strength potential, $\sigma_{min}(T)$ is the minimum strength potential, t is time and K(T) is a temperature dependent kinetic rate constant. FIG. 2 is a plot of the rate constant K(T) versus temperature. The maxima of this curve is determined to be the critical temperature, $T_{crit}$. At high and low temperatures, the rate constant approaches zero. The loss of strength potential associated with a loss of solute from solution also approaches zero for high and low temperatures. At these temperatures, in or about $T_{crit}$, the kinetic constant is of significant magnitude to effect losses of solute from solution and hence lead ultimately to decreased strength. Since a goal of quenching is to minimize the loss of solute from solution, it follows that cooling rates, particularly through the range of temperatures surrounding $T_{crit}$, should be maximized.

To obtain the necessary data to determine both the $T_L$ and $T_{crit}$, experiments were conducted by performing an elevated temperature quench on a thin sample fitted with a thermocouple using a uniformly distributed droplet type spray nozzle. FIG. 3 shows a typical thermocouple temperature measurement taken during the water quench. As stated above, the sharp break in the curve denotes $T_L$.

FIG. 4 is also data from this same experiment were the heat flux at the sample surface undergoes a rapid order of magnitude increase as the sample is cooled below the temperature $T_L$. Above $T_L$, the sample is blanketed by a vapor film which limits heat removal. When the temperature falls below $T_L$, the vapor film breaks down, the surface of the strand is wetted by the water droplets, and the heat flux increases dramatically.

To cool continuous and/or semi-continuous strands, the present invention employs an array of zoned water spray orifices to controllably vary the time wherein the strand remains above the critical wetting temperature $T_L$. FIG. 5*a* shows a multi-zoned array of spray orifices and a companion illustration of the strand temperature response as sequential water zones 21, 22, 23 and 24 are activated which correspond to their opposing orifices 21*a*, 22*a*, 23*a*, and 24*a* on the upper side of the quenching chamber. 20 is the air quenched curve without any liquid quench. The members in the multi-zoned array of spray orifices correspond to the curves 21*b*, 22*b*, 23*b*, 24*b* which is a plot of strip temperature verses distance from furnace exit. It is noteworthy that the sharp break in curve 24*b* at approximately 500° F. indicates that metal distortion may start due to the quickness of this cooling. This indicates that there is a limit to the amount of cooling or number of orifices that can be used in the liquid quench chamber before metal distortion is a problem.

FIG. 5*b* contains 21*c*, 22*c*, 23*c*, and 24*c* which are the corresponding curves showing tensile strength potential versus distance from the furnace exit. Curve 20*c* is the air quench curve and curve 21*c* is a one orifice liquid quench curve. This indicates that little if any benefit is realized with one spray orifice. Curve 22*c*, however, indicates that an increase in strength potential may be realized by adding an additional spray orifice. Curves 23*c* and 24*c* indicate that adding one more spray increases the strength potential again, but that adding an additional spray orifice nets little additional benefit. There could, of course, be n number of zones assuming some benefit is received for the $n^{th}$ zone. In this instance, up to 3 zones can be used in the quench while maintaining the strand temperature above $T_L$. For a given liquid quenching system and operating conditions, the number of activated zones depends on the speed of the strand translation and the geometric dimensions of the strand. Embraced by this invention are multiple zones either top, bottom or side zones to the plane of the strand translation. The length of the liquid quench chamber may be varied, consistent with desired liquid quench residence times.

It is noted that with no water used and the metal alloy air quenched, the strength potential of the metal alloy drops off from 20,100 psi to 19,650 psi within about 16 feet from the furnace exit. With single spray orifice, the loss of strength potential is quicker but reaches approximately the same strength potential as with no liquid quench. Surprisingly, adding the second spray orifice drops the strength potential of the alloy a little quicker, but the strength potential drop off is about 19,900 psi. This is an improvement of about 56% less strength potential loss over the single spray orifice and the air quench. A third spray orifice improves the increase in strength potential by an additional 40% over the two spray orifice and 78% over a single spray orifice and air quench. This improvement is made without the physical distortion to the metal alloy strip that it is desired to avoid. The strip in this instance was a 6111 series aluminum alloy, as designated by the Aluminum Association registration system, it was 0.04 inches thick, with a horizontal translation of 100 fpm. The temperature of heat treatment was approximately 1060° F.

In order to better understand the invention hereof, the experimental data was modeled to produce the curves of FIGS. 6*a* and 6*b*. The curve 30 shows the temperature drop of the strip when the spray orifices in liquid quench chamber 10 are placed further from the furnace exit and correspond to placement at 21, 22, 21*a*, and 22*a*. The curve 31 shows the temperature drop of the strip when the spray zones are placed closer to the furnace exit and correspond to spray zone placement at 23, 24, 23*a*, and 24*a*. FIG. 6*b* shows curves 32 and 33. Curve 32 corresponds with strip temperature curve 30 and curve 33 corresponds with strip temperature curve 31. Curve 32 indicates that strength potential can be increased by simply moving the spray zones further away from the furnace exit. For the same temperature drop and same number of spray zones, moving the orifices provides a strength potential increase of 150 psi.

It is noted, then, that quench rates can be affected by several different variables which can be used to design a different apparatus 1 and be applied to different worked and/or heated alloys. For example, residence time can be varied by changing the length of the run and/or by changing the time of the run. Instead of 100 fpm for 4 feet of quenching chamber, the length of the run could be, for example, varied to 8 feet of quenching chamber at a run speed of 50 fpm. It is entirely conceivable within the practice of the present invention that the liquid quenching is performed in a stationary mode to a forged or cast product. This dependence can also be varied by the number of orifices, although a fourth orifice in the above illustration in FIG. 6 did not increase the strength. The effect on strength will vary from alloy to alloy, dependent upon $T_{crit}$ and $T_L$. A final impact on the length of run and/or residence time in the quenching chamber is the heat treatment administered.

What is claimed is:

1. A process for the manufacture of a metal alloy wherein said metal alloy is subjected to a heat treatment and then is cooled with a controllably variable liquid quenching means to rapidly cool the metal alloy at or above the Leidenfrost temperature for said metal alloy, and then is cooled with an air quenching means, whereby said metal alloy is quenched without metal alloy distortion providing a metal with superior tensile strength properties.

2. The process of claim 1, wherein said controllably variable liquid quenching means is comprised of a single or a plurality of liquid quenching zones whereby said zones create a mist of varying length dependent upon the number of liquid quenching zones employed and a varying cooling intensity dependent on the application means of the liquid.

3. The process of claim 1, wherein said liquid is comprised water and dissolved gases.

4. The process of claim 1, wherein said liquid is comprised of a combination of water and glycol.

5. The process of claim 1, wherein said liquid is comprised of a combination of water and organic solvent.

6. The liquid of claim 1, wherein said liquid is comprised of water.

7. The process of claim 1, wherein cooling rates are sufficiently high to retain solute in solid solution but not in excess of those which lead to permanent plastic distortion.

8. The process of claim 1, wherein said metal alloy is comprised of aluminum alloy.

9. The process of claim 1, wherein said metal alloy is selected from the group consisting of 2xxx, 6xxx, and 7xxx series aluminum alloys.

10. The process of claim 1, wherein said metal alloy is heat treatable.

11. The process of claim 1, wherein said metal alloy is selected from the group consisting 6111, 2008, and 6022 series aluminum alloys.

12. The process of claim 1, wherein said controllably variable liquid quenching means is comprised of an upper and a lower bank of liquid quenching zones.

13. The process of claim 1, wherein said controllably variable liquid quenching means is comprised of an upper and a lower bank of liquid quenching zones wherein said zones are comprised of a plurality of liquid dispensing nozzles.

14. The process of claim 1, wherein said metal alloy is a strand of metal in a range of about 0.03 inches to about 8 inches in cross sectional thickness.

15. The process of claim 1, wherein said controllably variable liquid quenching means comprises a plurality of zones selected from 1, 2, 3, 4 up to n zones dependent upon strand thickness and translational speed of the strand.

16. The process of claim 1, wherein said heat treatment comprises heating said metal alloy within a temperature range of about 600° to 1200° F.

17. The process of claim 1, wherein said Leidenfrost temperature is about 350° to 700° F.

18. The process of claim 1, wherein when a strand exits the liquid quenching means at or above the Leidenfrost temperature the strand is substantially free of liquid induced staining.

* * * * *